United States Patent [19]

Steinbock

[11] 4,104,995

[45] Aug. 8, 1978

[54] VARIABLE COMPRESSION ENGINE

[76] Inventor: Rolf Steinbock, 603 Lindsay Rd., Carnegie, Pa. 15106

[21] Appl. No.: 750,904

[22] Filed: Dec. 15, 1976

[51] Int. Cl.[2] ..... F02B 75/04

[52] U.S. Cl. ..... 123/78 D; 123/51 AA; 123/78 A

[58] Field of Search ..... 123/48 A, 48 R, 48 D, 123/48 B, 51 AA, 51 BA, 78 R, 78 A, 78 B, 78 F, 90.15, 90.31

[56] References Cited

U.S. PATENT DOCUMENTS

| | | | |
|---|---|---|---|
| 1,435,777 | 11/1922 | Williams | 123/48 A |
| 2,145,017 | 1/1939 | Tsuneda | 123/48 A |
| 2,392,371 | 1/1946 | Fisher | 123/48 A |
| 2,420,779 | 5/1947 | Holmes | 123/51 BA |
| 3,254,636 | 6/1966 | Faust | 123/78 A |
| 3,331,256 | 7/1967 | Morris | 123/90.15 |
| 3,416,502 | 12/1968 | Weiss | 123/90.15 |
| 3,441,009 | 4/1969 | Rafanelli | 123/90.15 |
| 3,496,918 | 2/1970 | Finlay | 123/90.15 |
| 3,961,607 | 6/1976 | Brems | 123/78 D |
| 3,986,351 | 10/1976 | Woods et al. | 123/75 E |

*Primary Examiner*—Charles J. Myhre
*Assistant Examiner*—David D. Reynolds
*Attorney, Agent, or Firm*—Thomas H. Murray

[57] ABSTRACT

A diesel, gasoline or gas internal combustion engine adapted for operation on a two-cycle or four-cycle basis includes apparatus to vary the compression ratio of gases during operation of the engine. Two pistons, connected to separate crankshafts, communicate with each other in a single internal combustion chamber. One piston is reciprocated by a crankshaft in one cylinder portion to convert thermal energy into mechanical energy. The displacement of the one piston defines a fixed compression ratio and the displacement of a second piston by a second crankshaft in the other cylinder portion operates in the combustion chamber to a second fixed compression ratio. The two crankshafts are coupled together through timing means used to change the relative rotational phase relation between the crankshafts whereby a net compression ratio is formed as components of the compression ratios of both pistons. In one embodiment, differential gearing is coupled to the two crankshafts for changing the relative rotational phase relation between them; while in the second embodiment, sprocket wheels on the crankshafts are joined together by an endless chain. The lengths of the chain at the drive side and the slack side are adjusted by moving idler sprockets or shoes to thereby change the relative rotational phase relation between the two crankshafts. A servo control system responsive to the output of a supercharger is used to effect phase changes between the two crankshafts.

14 Claims, 11 Drawing Figures

VARIABLE COMPRESSION ENGINE

BACKGROUND OF THE INVENTION

This invention relates to an internal combustion engine of either a gasoline, gas or diesel engine in the form of a four-cycle or two-cycle type which may include a mechanically-driven supercharger or a turbocharger to provide an initial compression of gases but essentially including apparatus to vary the internal compression of gases within each combustion chamber of the engine; and more particularly, the present invention relates to such an apparatus to provide a variable compression ratio in a common combustion cylinder by providing at least two pistons with separate crankshafts and means interconnecting the crankshafts to change the rotational phase relation therebetween and thereby the extent to which the gases are compressed into the combustion chamber.

As is known in the art, gasoline, gas or diesel engines designed for a two-cycle or four-cycle operation usually have a fixed compression ratio based on the displacement of gases by the movement of a piston within a cylinder closed at one end where a combustion chamber is usually formed. The fixed compression ratio is a design compromise to provide, on one hand, a sufficiently high compression ratio for a usable output from the engine; while on the other hand, avoiding excessive forces on the parts including excessive demands for bearings, rings, etc. Frequently, supercharging of gases into the cylinders, particularly in regard to diesel engines, produces a compression ratio which is too high, thereby developing excessive mechanical forces on the parts as well as an unacceptable $NO_x$ content in the combustion gases. Some prior known measures have been suggested to vary the compression ratio by using valves for the addition of gases into the combustion chamber but severe problems develop in regard to the operation of these valves. Pistons have been made extendible by a threaded connection with a connecting rod. Pistons, after resting in one position during operation for a period of time, have a tendency to freeze in that position. Another attempt to change the compression ratio is directed to changing the combustion chamber volume by moving the cylinder head and/or movably lowering of the crankshaft but excessively high forces are encountered when undertaking the design of suitable apparatus to provide movement of such parts.

The desirability for varying the compression ratio becomes particularly acute in regard to supercharged engines where there is an ever-increasing development of excessively high forces after the engine is started. The forces increase during warm-up and become maxiumum under high-load conditions. In regard to a diesel engine adapted for automotive use, there is a critically deficient power at low speeds while the maximum speed of the engine is usually around 4000 RPM's. In a diesel engine, the compression ratio must be at least 20:1 and even 25:1 to start an engine. However, a compression ratio of this magnitude becomes a detriment during supercharging and maximum load conditions. This is because the pressure in the cylinder does not remain constant. During start-up, there is polytropic compression leaning toward the isothermal-thermodynamic condition; while at full speed, there is polytropic compression leaning toward the adiabatic-thermodynamic condition. Moreover, supercharging increases the compression ratio.

SUMMARY OF THE INVENTION

It is an object of the present invention to provide an apparatus to vary the compression of gases in an internal combustion engine wherein two crankshaft piston systems which work in a common combustion chamber can be changed in their displacement phase relation to each other, thereby changing the effective compression ratio.

It is still a further object of the present invention to provide an internal combustion engine wherein two crankshaft piston systems working on a common combustion chamber are controllably changed in regard to their displacement phase relation with respect to each other through differential gearing in one aspect of the invention or through a chain drive in another aspect of the invention wherein sprockets on the crankshafts undergo relative rotational movement by changing the length of an endless chain at the drive and slack sides of the sprockets.

It is a further object of the present invention to provide an internal combustion engine wherein two crankshaft piston systems which work on a common combustion chamber to compress gases therein together with a supercharges for feeding gases at an initial pressure into the chamber whereby the total combined compression ratio is maintained at a substantially constant value throughout operation of the engine including the combination of supercharging and cylinder compression as well as during start-up periods when the supercharger is inoperative.

More particularly, according to the present invention, there is provided in an internal combustion engine an apparatus to vary internal compression of gases during operation of the engine, the combination including casting means defining two cylinders communicating with an internal combustion chamber, a first piston reciprocating in one of the cylinders to convert thermal energy into mechanical energy, a first crankshaft coupled for displacing the first piston to operate at a first fixed compression ratio in the common combustion chamber, a second piston to reciprocate in the other of the cylinders, a second crankshaft coupled for displacing the second piston to operate at a second fixed compression ratio, and timing means to change the relative rotational phase relation between the first and second crankshafts for varying the net compression ratio formed as components of the first and second fixed compression ratios.

In the preferred form of the present invention, the aforementioned timing means includes means for turning one of the first and second crankshafts relative to the other. Differential gearing coupled between the first and second crankshafts is one form of means to change the relative rotational phase relation while a second form of means includes sprockets on the first and second crankshafts joined together by an endless drive chain. Idler sprockets and/or guide shoes engaging the drive chain at the drive and slack sides thereof are moved for adjusting the relative angular relation between the crankshafts. A servo controller coupled to at least one of the idler sprockets or guide shoes is used to change the length of the chain at the drive and slack sides for adjusting the relative angular relation between the crankshafts. A hydraulic fluid actuator is one form of servo controller, while in another form, a mechanical actuator is employed. The servo controller is preferably coupled for response to the operation of a supercharger to maintain a desired compression ratio which, in the preferred aspect of the present invention, is maintained at a substantially constant value notwithstanding the operative status or thermal condition of the engine as well as a supercharger, particularly when the supercharger is in the form of an exhaust gas supercharger. It is to be understood that the foregoing construction and relationship of parts for varying the compression of gases by two pistons communicating with a single combustion chamber are particularly useful for a diesel engine; however the features and advantages of the present invention are equally applicable to a gasoline or gas engine and/or diesel engine adapted for operation on a two-cycle or four-cycle basis.

The apparatus of the present invention to vary the compression ratio of gases in a combustion chamber not only increases the power output from the engine but also minimizes the $NO_x$ content in the combustion gases. Most important advancement by the variable compression ratio concept is the reduction to very low limits of an $NO_x$ content in combustion gases. This is accomplished by lowering the net compression ratio during operation of the engine to the lowest acceptable value which is sufficient to maintain adequate combustion and ignition. By reducing the net compression of gases in a combustion chamber of an engine, the lower pressure and combustion temperature minimize the formation of $NO_x$ stemming from the nitrogen content of the air.

These features and advantages of the present invention as well as others will be more fully understood when the following description is read in light of the accompanying drawings, in which.

Figure 1:
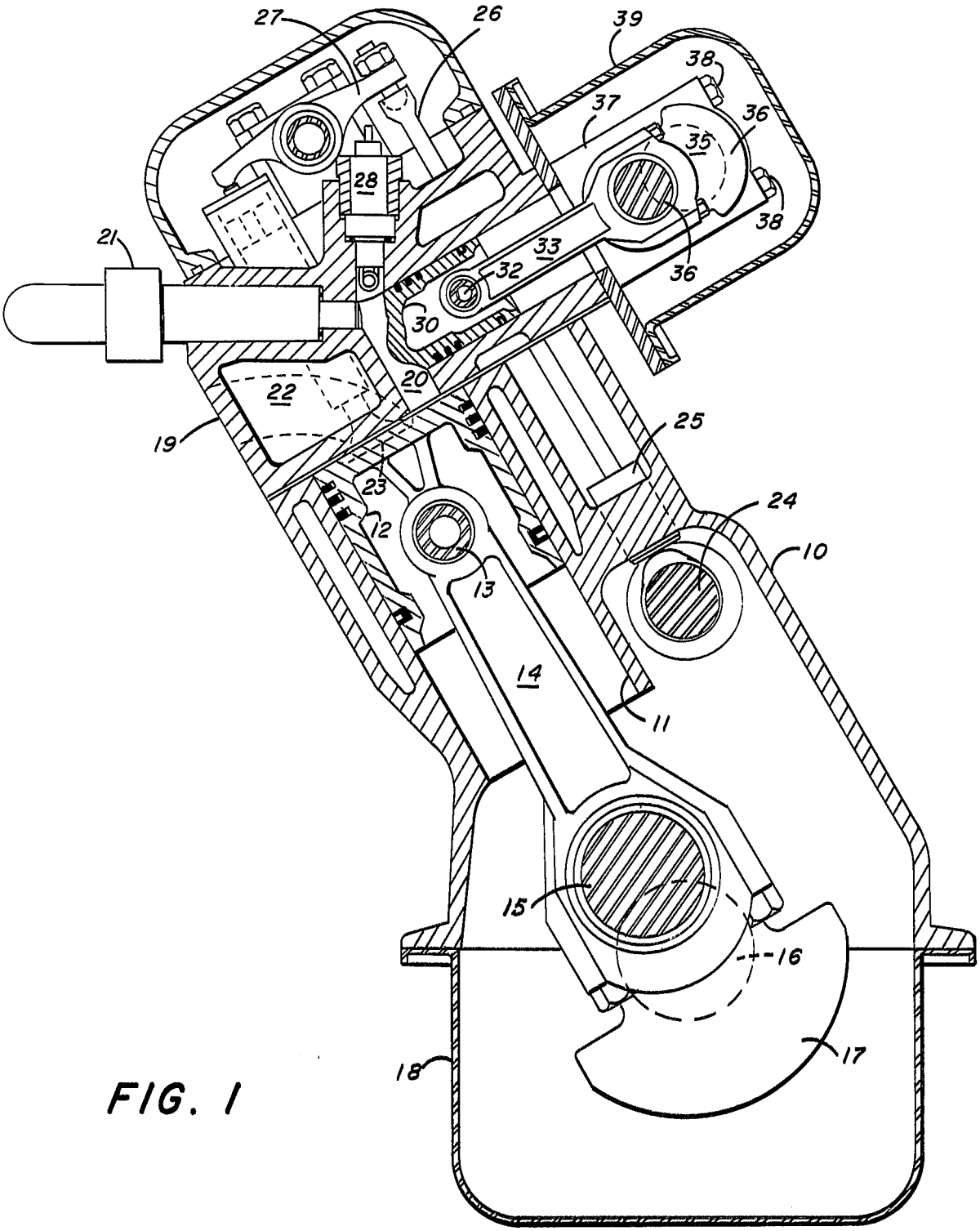
FIG. 1 is an elevational view, in section, through a combustion chamber of a multi-cylinder diesel engine embodying the features of the present invention.

In FIG. 1, there is illustrated a casting in the form of an engine block 10. A plurality of spaced-apart cylinder chambers 11, only one of which is shown in FIG. 1, is defined in the engine block 10. A piston 12 is coupled by a wrist pin 13 to a connecting rod 14 which is, in turn, journaled on an eccentric lobe 15 of a crankshaft 16. A counterweight 17 projects from the crankshaft at a diametrically-opposite location from the eccentric lobe 15. The bottom of the engine block 10 is closed in the usual fashion by an oil pan 18. Piston 12 is reciprocated toward and away from a head 19 which is also a casting and bolted in the usual way to the engine block 10. A combustion chamber 20 is formed in the head 19 and receives a charge of fuel from an injector 21 while exhaust gases from the combustion chamber are discharged through an exhaust opening 22 that is normally closed by a valve 23 whose position is controlled in response to a cam 24 coupled by a timing chain to the crankshaft 16 in the usual way. The cam 24 includes a lobe in engagement with a lifter 25 that, in turn, moves a push rod 26. Push rod 26 is joined to one end of a rocker arm 27 with the free end of the rocker arm engaging the stem of valve 23. The crankshaft 16 and cam shaft 24 are interconnected by a timing chain or gear in the usual way. The parts described thus far are well known in the art. The engine shown in FIG. 1 is a diesel engine whereby a glow plug 28 is energized just prior to and during the starting process of the engine.

According to the present invention, the compression of gases in the combustion chamber 20 is made variable through the use of a second piston 30 which is moved within a cylindrical surface 31 formed in the head 19. The piston is connected by a wrist pin 32 to a connecting rod 33 which is, in turn, journaled to an eccentric 34 of a second crankshaft 35. A counterweight 36 extends from the crankshaft 35 at an oppositely-disposed relation from the eccentric 34. The crankshaft 35 is rotatably supported by bearing blocks 37 which are secured to the head 19 by bolts 38. The crankshaft 35 is located within an enclosure which includes a cover 39 to provide a protective environment wherein forced lubrication of the bearing surfaces is carried out in a manner which is per se well known in the art. The compression of gases in combustion chamber 20 is carried out through the concerted effect by pistons 12 and 30. The extent to which gases are compressed is controlled in a variable manner according to the present invention by the phase relation between the crankshafts 16 and 35.

Figure 2:
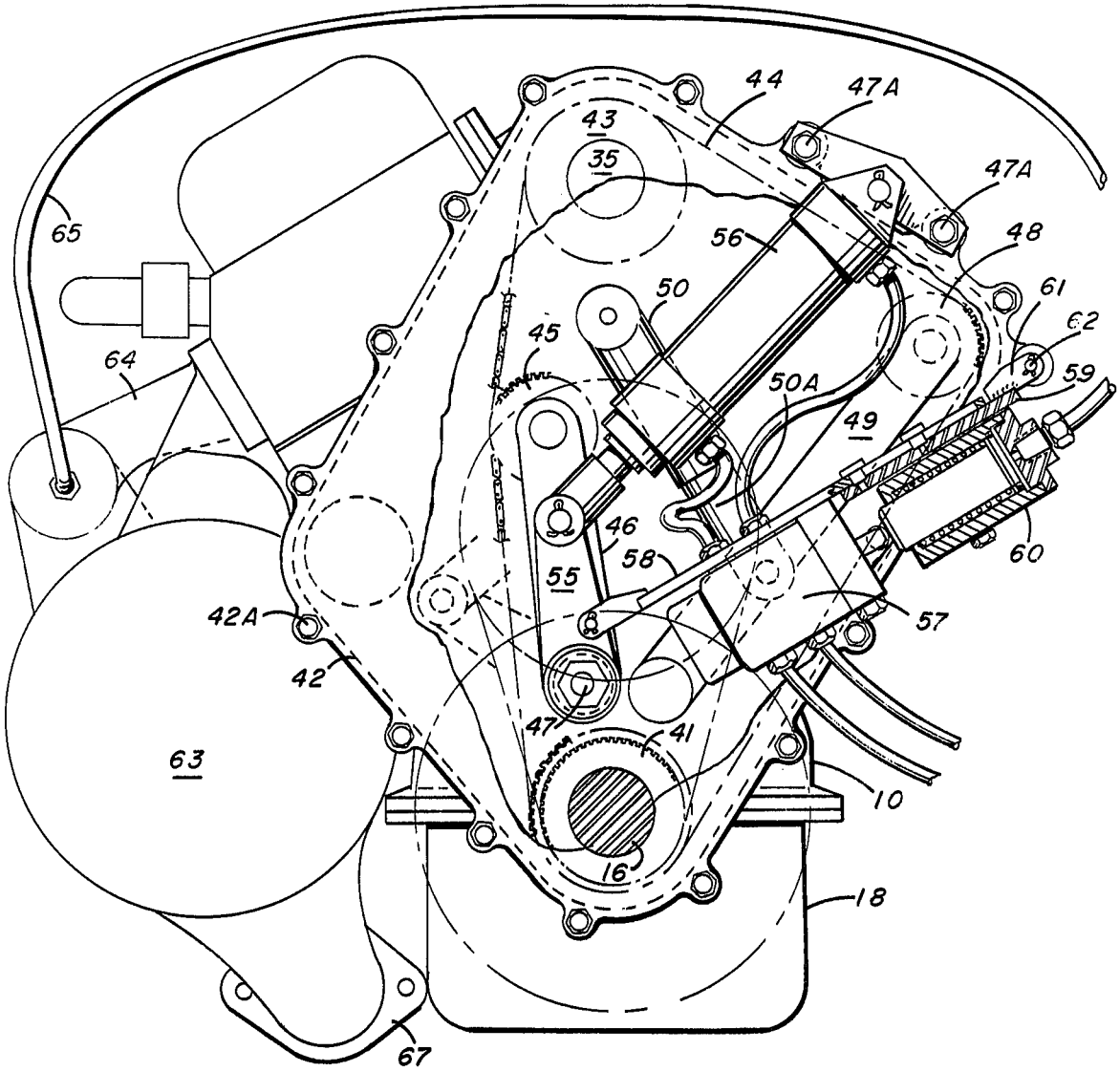
FIG. 2 is a front end elevational view of the diesel engine shown in FIG. 1.

One form of apparatus to control the phase relation between these crankshafts is shown in FIG. 2. A sprocket 41 is secured to the crankshaft 16 at its end which projects outwardly beyond the engine block 10 and the oil pan 18. The sprocket 41 is located within a split housing 42 which is joined together by bolts 42A. A sprocket 43 is secured to crankshaft 35 at an end which projects into the housing 42. A drive chain 44 is trained about the sprockets 41 and 43. An idler sprocket 45 is rotatably supported at the end of a pivot arm 46 which is attached by a pivot shaft 47 to the engine block. The idler sprocket 45 engages the drive chain at the tensioned or drive side of the chain between the sprockets 41 and 43. A second idler sprocket 48 engages the chain at the slack side between sprockets 41 and 43. The second idler sprocket 48 is supported at the end of a pivot arm 49 which is supported for pivotal movement by a shaft secured to the engine block. The pivot arm 49 is urged under a constant resilient force by a spring or hydraulic tension assembly 50 which is in the form of a cylinder supported at one end by the engine block and by a movable piston which includes a clevis 50A that is, in turn, engaged with the pivot arm 49. The resilient force developed by the spring 50 or hydraulic pressure is imposed on the second idler sprocket 48 so as to maintain a tension on the drive chain 44 at the slack side. The length of chain at the slack side and the drive side of sprockets 41 and 43 are adjustably controlled through a servo system to be hereinafter described to thereby vary the rotational phase relation between the crankshafts to which pistons 12 and 30 are coupled to thereby vary the extent to which gases are compressed in the combustion chamber. In a diesel engine, the gas undergoing compression is air; whereas in a gasoline or gas engine, the gases are a mixture of air and fuel.

The servo system shown is located at an outwardly-spaced location from the interior of the housing 42. Shaft 47, which pivotally supports arm 46, is extended through the housing 42. A pivot arm 55 is secured to the extended end of shaft 47. The free end of pivot arm 55 is secured to the rod end of a piston and cylinder assembly 56 which is mounted at its cylinder end by a clevis plate which is secured to housing 42 by bolts 42A. The piston and cylinder assembly 56 is controlled in the manner of a master slave cylinder in response to the output of a servo valve 57. The servo valve is supported by a plate 58 that is attached by a bracket to pivot arm 55. A longitudinal slot in the opposite end of plate 58 supports enlarged heads of guide pins carried by a slide plate 59 onto which there is attached a pressure sensor and positioner 60. The slide plate 59 is connected to a bracket 61 that is supported for pivotal movement by a pin 62 extending from the housing 42. In the preferred embodiment of the present invention, the diesel engine includes an exhaust gas supercharger 63 which is powered by exhaust gases discharged through the valves 23 of the various cylinders forming part of the diesel engine. The exhaust gases drive a turbine forming part of the supercharger. The output from the supercharger is in the form of compressed air, all of which is directed through a manifold 64 for supercharging the cylinders in the engine through the usual intake valves which are similar to valves 23 and controlled by cam 24. A portion of the compressed air is delivered by line 65 to the pressure sensor and positioner 60 which is preferably in the form of a piston and cylinder assembly having a movable cylinder which engages the servo valve 57. The pressure developed by the cylinder of the pressure sensor is used to control the servo valve which, in turn, delivers at a proportional pressure hydraulic fluid to the cylinder 56 which, in turn, displaces the idler sprocket 45. Displacement of the idler sprocket 45 produces a lengthening to the length of the drive chain between sprockets 41 and 43 at the drive side. This changes the rotational phase relation between the crankshafts 16 and 35. Accompanying displacement of the idler sprocket 45 is a movement by idler sprocket 48 against the resilient force exerted by the tensioning device 50. One or both of the idler sprockets 45 and 48 may be replaced by flat guide shoes with entry and delivery chain guide surfaces. The manner in which the servo valve operates throughout various relative operations by the diesel engine will be discussed in greater detail hereinafter. The exhaust gases from the supercharger pass through a muffler 67 in the usual manner.

Figure 4:
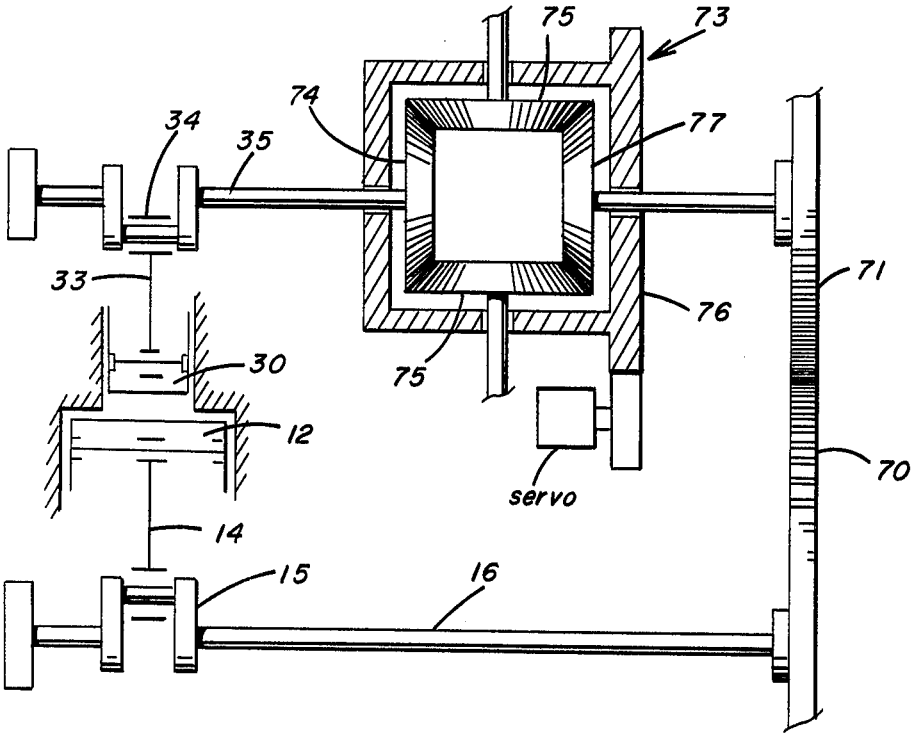
FIG. 4 is a schematic illustration of differential gearing to vary the phase relation between the crankshaft piston system of the present invention.

FIG. 4 illustrates schematically the use of differential gearing in place of the arrangement of a servo control slave cylinder to control the phase angle relation between the two crankshafts 16 and 35. As shown in FIG. 4, the piston 12 is coupled by the connecting rod 14 to eccentric lobe 15 of crankshaft 16 which is connected to a gear 70. A second gear 71, meshing with gear 70, is connected to a drive gear 72 of a differential gearing assembly 73. The differential gearing assembly further includes a drive gear 74 which is coupled to crankshaft 35 which, as previously described, includes an eccentric lobe 34 which is connected by connecting rod 33 to piston 30. The differential gearing assembly 73 further includes planetary gears 75 which are supported by shafts carried by a rotatable housing 76. The housing 76 is rotated by a servomotor or the like to change the phase relation between crankshafts 35 and 16 and thereby vary the extent to which gases are compressed in the combustion chamber by pistons 12 and 30. It will be understood, of course, that the servomotor is driven by a suitable source of electrical energy or, alternatively, by a generator or the like powered by the supercharger so that the rotation of the servomotor corresponds to compressive gas output by the supercharger.

Figure 7:
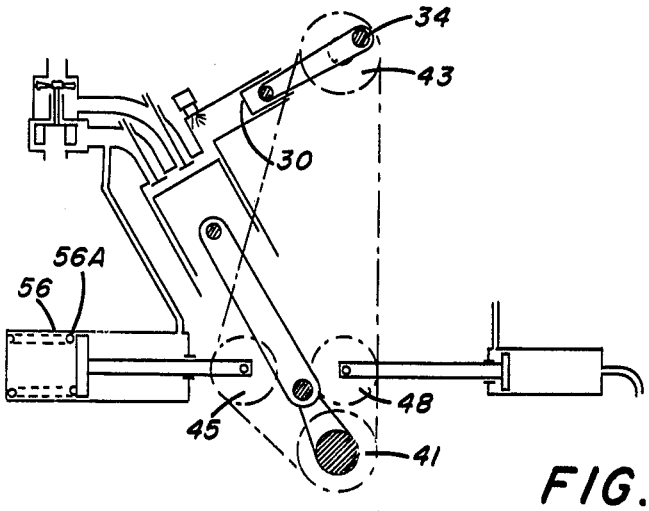
FIG. 7 is a view similar to FIGS. 5 and 6 but illustrating the relative arrangement of parts during full-load on the diesel engine.
Figure 6:
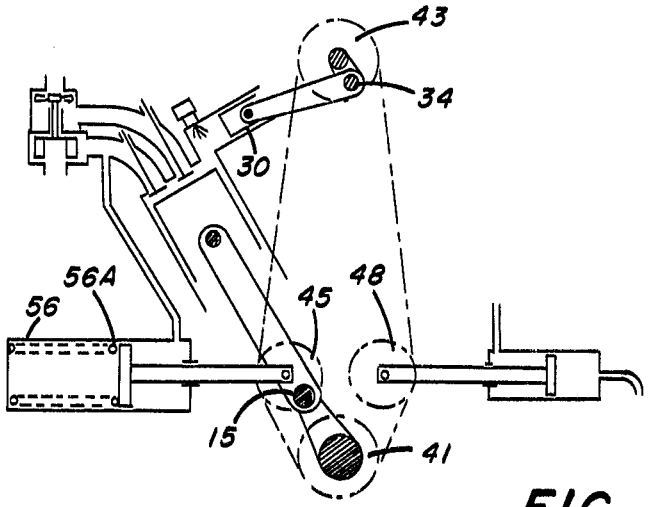
FIG. 6 is a view similar to FIG. 5 but illustrating the relative arrangement of parts during a partial-load condition on the diesel engine.
Figure 5:
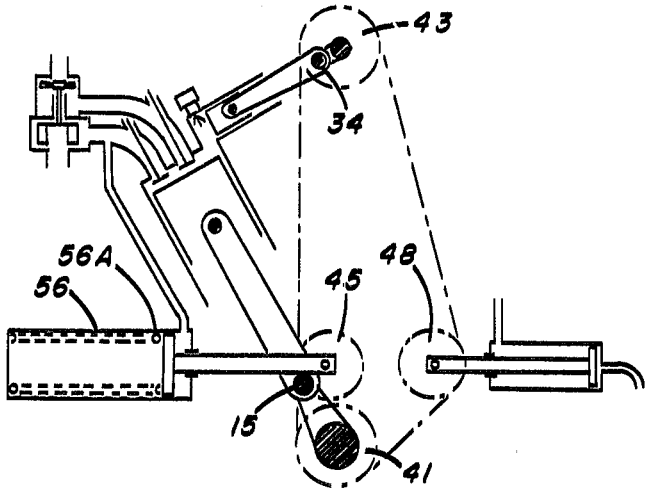
FIG. 5 is a schematic view illustrating the arrangement of parts during start-up of the diesel engine shown in FIGS. 1 and 2.

FIGS. 5, 6 and 7 illustrate three phase relations between the crankshafts associated with pistons for each combustion chamber. In FIG. 5, a relationship of parts is shown in regard to the start-up mode of the diesel engine. The relative phase angle relationship between crankshafts 16 and 35 is synchronous or matching in that when crankshaft 16 displaces cylinder 12 to a top dead-center position, then crankshaft 35 displaces cylinder 30 to its top dead-center position concurrently. This, of course, causes a maximum compression of gases in the combustion chamber which, in the diesel engine during start-up procedure, is preferably at about 25:1 compression ratio. To achieve this desired maximum compression ratio, the servo control idler sprockets 45 and 48 are in the null position whereby the slave piston and cylinder assembly 56 shown by a direct couple to the supercharger output, is in a fully-extended position under a spring force developed by a spring 56A as part of the slave cylinder. Tension on the drive chain is maintained at the slack side by idler sprocket 48. As is the usual practice, immediately prior to start-up of a diesel engine, the glow plug 26 is energized to facilitate the initiation of combustion gases in the combustion chamber.

FIG. 6 illustrates the arrangement of parts during operation of the engine while supercharged with gases by delivery of the exhaust gases to the supercharger. Under these conditions, the pressure of the supercharging gases is delivered to one side of the slave cylinder 56 causing displacement thereof against the spring force developed by spring 56A. This causes a displacement of idler sprocket 45, thus increasing the length of the chain at the drive side between sprockets 41 and 43 and a shortening of the length of the chain at the slack side between sprockets 41 and 43. The slack side of the chain is maintained under a desired predetermined tension by the tensioning cylinder 50. However, because the length of the chain at the drive side has been increased between sprockets 41 and 43, the relative phase relation between crankshafts 16 and 35 has undergone a change which, in this instance, corresponds to approximately 90°. The 90° phase relation is such that when the piston 12 is in its top dead-center position, piston 30 is displaced midway along its compression stroke, thereby reducing the extent to which gases are compressed in the combustion chamber as compared with the arrangement of parts shown in FIG. 5. Because gases enter the combustion chamber under the influence of the supercharger, the compression ratio may, if desired, remain at a net constant. That is, assuming for example, a compression ratio of 2:1 by the action of the supercharger, than the compression ratio produced as a total by displacements of the pistons 12 and 30 is at 1:10, then the total compression ratio of gases within the combustion chamber turns out to be at a ratio of 1:20.

FIG. 7 illustrates a full-load condition on the diesel engine in which the exhaust gases from the engine drive the supercharger for a maximum output which, in turn, produces a maximum displacement of the piston in the slave piston and cylinder assembly 56, thereby further increasing the phase displacement relation between crankshafts 16 and 35 whereby when piston 12 is at its top dead-center position, then piston 30 is at its bottom position whereby the compression ratio produced by displacements of the two pistons is at a relative minimum while the extent of supercharging is at a relative maximum with the net compression ratio remaining substantially constant. In the position of parts shown in FIG. 7, the length of drive chain at the drive side between sprockets 41 and 43 is at the maximum while the length at the slack side is at the minimum whereby the tensioning sprocket 48 is displaced to its maximum extent.

Figure 8:
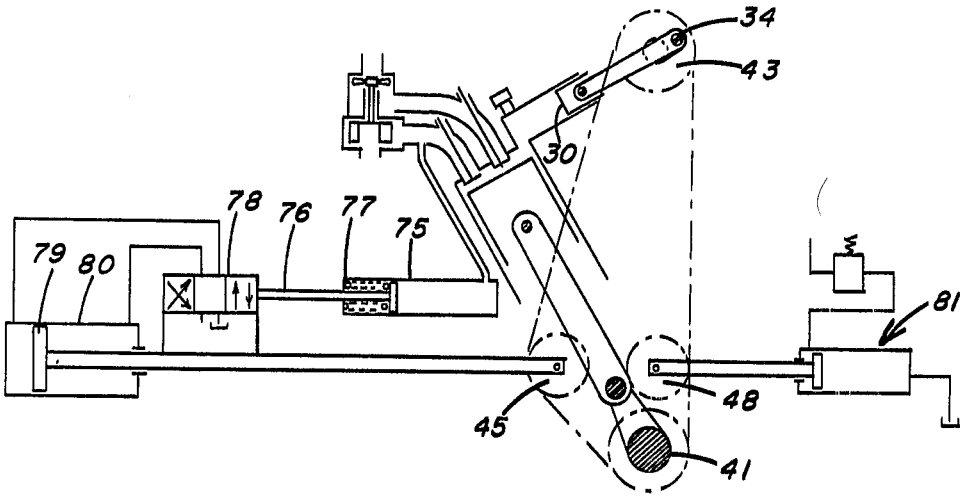
FIG. 8 is a view similar to FIGS. 5–7 but illustrating a further embodiment of the present invention including the use of a hydraulic servo.

FIG. 8 is a schematic view of the parts essentially as shown in FIGS. 5–7, but illustrating a modified embodiment of the servo control mechanism wherein instead of directly applying the output from the supercharger to the slave cylinder as in FIGS. 5–7, the output of the supercharger is applied to a positioning cylinder 75. The pressure of the gases introduced into the cylinder 75 produces displacement of a piston 76 against a substantially constant spring force provided by spring 77. The piston rod is connected to a four-way hydraulic servo valve 78 which controls the flow direction and magnitude of hydraulic pressure applied to the opposite sides of the piston to thereby control the position of idler sprockets 45. At the slack side of the drive chain 44, the idler sprocket 48 is urged under a constant force by a hydraulic dashpot cylinder assembly 81. The servo valve 78 may, if desired, be operated by other positioning means than the positioning cylinder 75. For example, a servomotor coupled to a switch on the instrument panel of the vehicle may be used. Moreover, a servomotor responsive to a heat detector for exhaust gases may be used to control the servo valve 78.

Figure 3A:
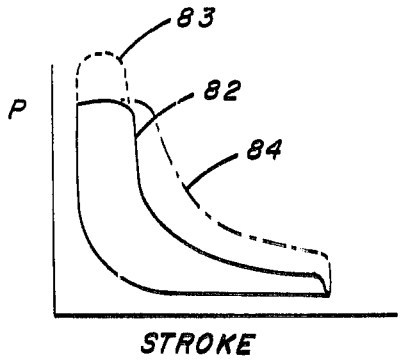
FIGS. 3A and 3B are graphs illustrating, by comparison, the pressure v. stroke relation for a diesel and gasoline engine of the prior art piston systems and the system of the present invention.
Figure 3B:
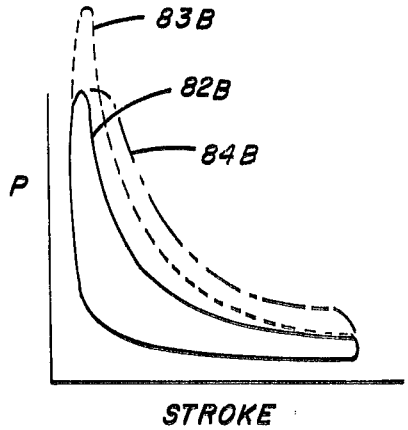

The graph in FIGS. 3A and 3B illustrates the pressure-stroke relationship of internal combustion engines. In FIG. 3A graph line 82 outlines the pressure-stroke relationship of a conventional diesel engine. In FIG. 3B graph line 82B outlines the pressure-stroke relationship of a conventional gasoline engine. It will be observed that the maximum pressure exists for only a relatively short length of stroke by the piston after which the pressure falls at a very rapid rate. The area enclosed by graph line 82 and graph line 82B represents the work done by the cylinder of each type of engine. Graph lines 83 and 83B outline the pressure-stroke relationships of a supercharged conventional diesel engine and a supercharged conventional gasoline engine, respectively. It is significant to note that the pressure increases substantially and for a longer duration by the stroke of the piston. This is highly undesirable as noted hereinbefore in regard to the development of excessive forces on the parts notably including the crankshaft, connecting rod and piston rings. Moreover, excessive amounts of $NO_x$ occur because of the increased pressure and combustion temperature. It is highly desirable to avoid this excessively large pressure but yet achieve a longer duration to the existence of a relatively high pressure in regard to the stroke of the piston. This is accomplished, according to the present invention, as represented by graph lines 84 and 84B. Graph line 84 represents the combination of a supercharged cylinder wherein the peak pressures have been kept low by increasing the volume of the combustion chamber by means of the variable compression ratio concept. It will be noted, of course, that the area within the graph line is increased, and since area represents work, the work done by the cylinder is increased without a corresponding increase in peak pressures.

The same comment and relationship exists in regard to graph line 84B which represents the combination of a supercharged cylinder of a variable compression ratio gasoline engine.

A highly significant and important aspect of the present invention resides in the fact that the power output by a given diesel or gasoline engine whether operating on the basis of a four-cycle or two-cycle is substantially increased without increasing the rotational speed of the engine. This, of course, eliminates the need to increase bearing capacities and the like. A diesel engine intended for operation at 4000 RPM's maximum, will produce a far greater horsepower output by the variable compression ratio concept of the present invention at all speeds up to the same 4000 RPM's maximum speed. The notoriously low power output from diesel engines at low speeds is no longer a characteristic of a diesel engine which embodies the features of the present invention.

Figure 9:
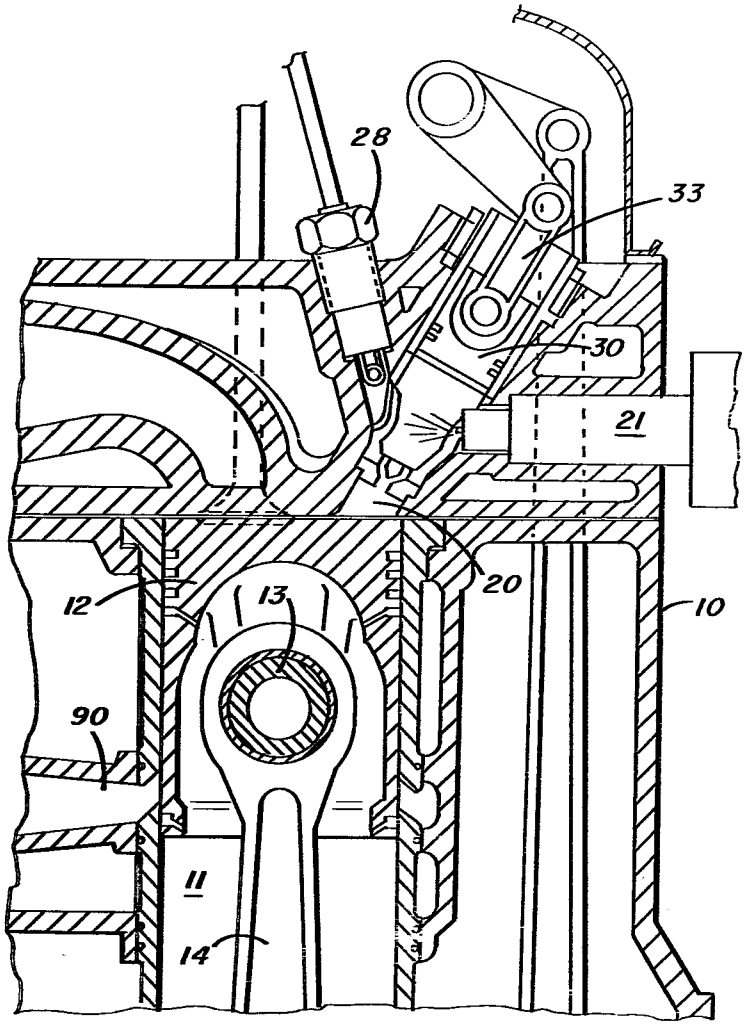
FIG. 9 is a view similar to FIG. 1 but illustrating an arrangement of parts to provide a two-cycle diesel engine.

FIG. 9 illustrates an embodiment of the present invention as applied to a two-cycle diesel engine. It will be noted that an exhaust port 90 opens out of the cylinder wall for the exhausted gas. The piston 30 is still arranged in the head of the engine but not at the right angle stroke relation as shown in FIG. 1. Moreover, the glow plug and fuel injectors are associated with the cylinder portion of the piston 30 for feeding gases into the combustion chamber 20.

Figure 10:
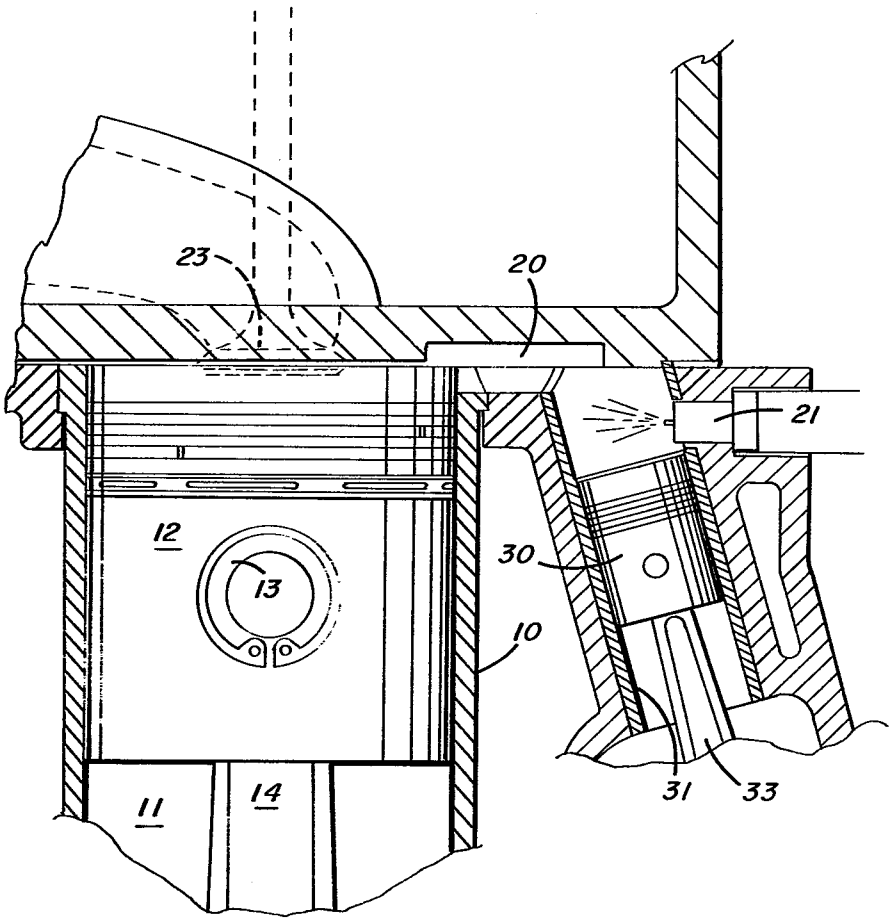
FIG. 10 is a view similar to FIG. 1 but illustrating an arrangement of parts to provide a modified four-cycle diesel engine.

FIG. 10 illustrates a further modified arrangement of parts for providing a diesel engine wherein the piston 30 cooperating with combustion chamber 20 reciprocates along a path of travel that is at an angle of about 15° to the path of travel by the piston 12. Both pistons reciprocate in cylinders formed in the engine block 10 and the combustion chamber 20 takes the form of a recess in the head casting of the engine.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In an internal combustion engine, an apparatus to vary the effective compression ratio during operation of the engine, the combination comprising:

casting means defining two cylinders communicating with a common combustion chamber, a first piston reciprocating in one of said cylinders to convert released thermal energy into mechanical energy, a first crankshaft coupled for displacing said first piston to operate at a first fixed compression ratio in said common combustion chamber, a second piston reciprocating in the other of said cylinders, a second crankshaft coupled for displacing said second piston to operate at a second fixed compression ratio in said combustion chamber, timing means to change the relative rotational phase relation between said first and second crankshafts for varying a net compression ratio formed as a composite of said first and second fixed compression ratios at which gases are compressed in said combustion chamber by both of said first and second pistons, supercharged means to increase the pressure at which gases are introduced into at least one of said two cylinders for compression in said combustion chamber, and control means coupled to said timing means for adjusting the compression ratio of the two crankshaft piston systems automatically in relation to the supercharged pressure.

2. The apparatus according to claim 1 wherein said timing means includes means for turning one of said first and second crankshafts relative to the other.

3. The apparatus according to claim 1 wherein said timing means includes differential gearing coupled to said first and second crankshafts to maintain rotation thereof at a predetermined timed relation.

4. The apparatus according to claim 1 wherein said timing means includes an endless drive chain, a sprocket on each of said first and second crankshafts to engage said endless drive chain.

5. The apparatus according to claim 4 wherein said timing means further includes idler means to engage said endless drive chain at each of the drive and slack sides thereof while trained between the sprockets on said first and second crankshafts.

6. The apparatus according to claim 5 wherein said idler means includes an idler sprocket.

7. The apparatus according to claim 5 wherein said idler means includes a guide shoe.

8. The apparatus according to claim 5 wherein said control means further includes means to move said idler means to change the length of chain at both the drive and slack sides thereof for adjusting the relative angular relation between said first and second crankshafts.

9. The apparatus according to claim 8 wherein said control means further includes a servo controller to move one of said idler means.

10. The apparatus according to claim 9 wherein said servo controller includes a hydraulic fluid actuator.

11. The apparatus according to claim 9 wherein said servo controller includes a mechanical actuator.

12. The apparatus according to claim 1 further comprising means to direct exhaust gases from said combustion chamber for driving said supercharger.

13. The apparatus according to claim 1 wherein said control means and said timing means operate to maintain a substantially constant combined compression ratio of gases in said combustion chamber.

14. The apparatus according to claim 1 wherein said control means is responsive to the pressurization of gases by said supercharger.

* * * * *